United States Patent [19]

Jenkins, Jr.

[11] Patent Number: 5,067,260

[45] Date of Patent: Nov. 26, 1991

[54] OVERBOOT WADERS

[76] Inventor: Robert B. Jenkins, Jr., P.O. Box 2089, Gastonia, N.C. 28053

[21] Appl. No.: 495,083

[22] Filed: Mar. 19, 1990

[51] Int. Cl.[5] ..... A43B 3/16

[52] U.S. Cl. ..... 36/7.10 R; 36/9 R

[58] Field of Search ..... 36/7.1 R, 7.3, 109, 36/9 R

[56] References Cited

U.S. PATENT DOCUMENTS

| | | | |
|---|---|---|---|
| 1,258,024 | 3/1918 | Laybourn | 36/7.1 R |
| 1,312,781 | 8/1919 | Flannery | 36/7.1 R |
| 2,458,438 | 1/1949 | Snelling | 36/7.3 |
| 2,721,399 | 10/1955 | Emmer | 36/7.1 R |
| 2,799,951 | 7/1957 | Rogers | 36/7.1 R |
| 3,035,291 | 5/1962 | Bingham, Jr. | 36/9 R X |
| 3,744,158 | 10/1973 | Walker | 36/1.5 |
| 3,824,715 | 7/1974 | Vaughan, Jr. et al. | 36/7.3 |
| 3,991,492 | 11/1976 | Dreyer | 36/109 |
| 4,023,281 | 5/1977 | Terry | 36/9 R X |
| 4,083,124 | 4/1978 | Michalak | 36/7.1 R |
| 4,294,022 | 10/1981 | Stockli et al. | 36/9 R X |
| 4,376,344 | 3/1983 | Kimsey | 36/7.1 R |
| 4,562,834 | 1/1986 | Bates et al. | 36/9 R X |
| 4,809,447 | 7/1989 | Pacanowsky et al. | 36/9 R |
| 4,858,342 | 8/1989 | Nicholson et al. | 36/2 R X |
| 4,967,491 | 11/1990 | Plotkin | 36/7.1 R |
| 4,967,494 | 11/1990 | Johnson | 36/9 R |

FOREIGN PATENT DOCUMENTS

| | | | |
|---|---|---|---|
| 3606837 | 9/1987 | Fed. Rep. of Germany | 36/7.1 R |

*Primary Examiner*—Paul T. Sewell
*Assistant Examiner*—Ted Kavanaugh
*Attorney, Agent, or Firm*—Clifton Ted Hunt

[57] ABSTRACT

Overboot waders are of durable and lightweight construction to be drawn over the user's boots for use only while walking or standing in water during hunting and fishing. The waders are made from waterproof material shaped and bonded to form integral leg and foot portions. A multi-ply sole of waterproof material is shaped to fit either foot and bonded to the end edges of the foot portion.

3 Claims, 2 Drawing Sheets

OVERBOOT WADERS

FIELD OF THE INVENTION

The invention relates to lightweight knee and hip length waterproof boots of the type worn over shoes or boots and carried when not in use, as while hunting and fishing in woodlands and wetlands.

BACKGROUND OF THE INVENTION

Knee and hip length waterproof boots intended to be worn over shoes or boots are known in the prior art. See, for example, the following patents:

| PATENT NO. | ISSUE DATE | INVENTOR | TITLE |
|---|---|---|---|
| 1,264,123 | Apr. 23, 1918 | Pepper | WADING BOOT |
| 1,312,781 | Aug. 12, 1919 | Flannery | BOOT |
| 1,717,690 | June 18, 1929 | Ihnen | TRANSPARENT FOLDABLE FOOTWEAR |
| 3,017,705 | Jan. 23, 1962 | Peters | FOOT AND LEG APPAREL ARTICLE |
| 4,376,344 | Mar. 15, 1983 | Kimsey | INSULATED BOOT BLANKET |
| 4,516,336 | May 14, 1984 | Nissenbaum | PROTECTIVE OVERSHOE |

The boots shown by Pepper and Flannery are undesirably heavy and cumbersome for carrying when not in use.

The boots shown in the patents to Ihnen, Peters, and Kimsey are undesirably fragile for walking in woodlands and wetlands such as encountered while hunting and fishing.

Kimsey's boot is an insulative boot intended for use while the wearer is in a sedentary position such as occupying a deer stand or sitting in a cold stadium watching a football game. The Kimsey boots are relevant to the present invention only because they are carried to the place where they will be used. Unlike the waders of the present invention, they are not used while walking.

Nissenbaum shows a protective overshoe with collapsible body and leg portions made of plastic or plastic covered fabric and held in place on the user by elastic bands encircling the body portion of the overshoe after it is drawn on the user's foot and leg. The Nissenbaum protective overshoe is structured and used for urban wear with reinforced heel and sole to provide durable but heavy soles for walking. The leg portion is fragile and is not suitable for use in rough terrain and wading streams. The bulbous and fragile leg portions would be subject to being torn by brambles and the like if used in the woods.

SUMMARY OF THE INVENTION

The overboot wader of this invention is of lightweight, durable, waterproof constructioon with a flexible but self-supporting body portion formed from a single piece of fabric sealed to a multi-ply sole of generally rectangular planar configuration with rounded ends to fit either foot. The body and sole portions of the wader are large enough to be easily drawn over and easily removed from hunting boots worn by the user. Foot charts which show the size of overboot to fit over the different foot sizes of boots will show purchasers the correct size of overboot to fit over the purchaser's size of boot. A size 10 boot, for example, will require a larger size of overboot than will a size 7 boot. The overboot waders may be insulated, if desired.

The overboot waders are structured for maximum durability with minimum weight. They are made from heavy fabric with a waterproof lining on the inside and a water impervious coating on the outside. The outer coating protects the fabric from becoming soggy in use and preserves the waders for quick and convenient storage after use.

DETAILED DESCRIPTION OF THE INVENTION

Figure 8:
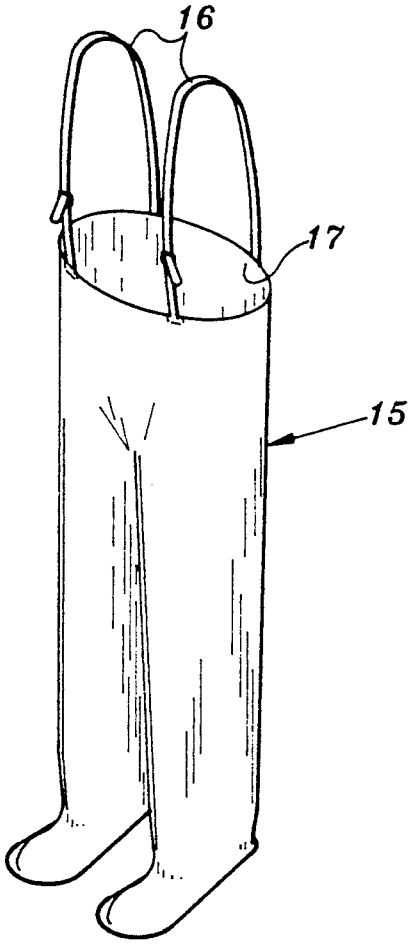
FIG. 8 is a perspective view of a chest-high wader.

Referring more specifically to the drawings, the numeral 10 broadly designates an overboot wader of the over-the-calf size and the numeral 11 broadly designates an overboot wader of the hip-length size. The construction of the waders 10 and 11 is the same, except that the over-the-calf wader has a drawstring 12 extending through a hem 13 at the top of the wader, and the hip-length wader has a strap 14 attached to its upper end to be connected to the waistbelt of the user. A chest-high wader 15 with suspender straps 16 and body portion 17 is illustrated in FIG. 8. Its construction is otherwise the same as the construction of the waders 10 and 11.

The construction of the waders will be otherwise described with reference to the over-the-calf wader 10 with the understanding that the description is also applicable to the hip-length wader 11 and the chest-high wader 15.

The wader comprises tubular leg and foot portions 18 and 20 and a two-piece flat sole portion 21. In the first described embodiment of the invention, illustrated in FIGS. 3 and 4, the leg and foot portions 18 and 20 are made from a single piece of sturdy tear resistant fabric 22, such as 500 denier nylon sold under the trademark CORDURA by E. I. DuPont de Nemours Company. The inner surface of the fabric 22 is continuously lined, as at 23, with a heat-sealable waterproof compound, such as urethane. The outer surface of the fabric 22 is coated as at 24 with a water impervious compound such as sold by Minnesota Mining and Manufacturing Company under the trademark SCOTCH GUARD.

The lined and coated fabric of the leg portion 18 has enough rigidity to be self sustaining when cut into a blank of desired dimensions. The blank is shaped into integrated leg and foot portions 18 and 20 before sealing the leg portion 18 into a tubular configuration by sealing together the adjoining end edges 25 and 26 of the heat-sealable waterproof lining 23 along the front of the wader from its top to the sole 21.

The preferred way of sealing the wader into a tubular configuration is with 100 pounds of pressure applied at a temperature of 400° F. for a 3 second pre-seal, a 2 second dwell, and 2 seconds cooling, coupled with radio frequency sealing.

The foot portion 20 is an uninterrupted extension of the leg portion 18, and is defined by simply enlarging the circumference of the leg portion 18.

As an example of the construction of the wader, one successful embodiment of the over-the-calf wader 10 measures nineteen inches from the top of the wader to the sole 21. The leg portion 18 has a circumferential measurement of twenty two inches at the top of the wader and tapers downwardly and inwardly to a circumference of twenty inches at a point F spaced six inches above the sole 21. Extending downwardly in the drawings from Point F, the circumference of the leg portion increases sharply over the next three inches from twenty inches at point F to a maximum of twenty eight inches at point T on the toe of the foot portion 20.

The bottom of the user's foot is covered by the sole 21, which comprises an inner panel 30 and an outer subjacent panel 31 formed from the same heavy cloth as the body portion 15, or from a heavier cloth such as 1,000 denier nylon if desired.

Figure 6:
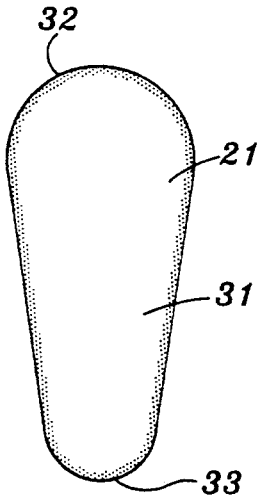
FIG. 6 is a bottom view of the sole.

The panels 30, 31 are generally rectangular but of slightly tapered configuration with rounded ends 32 and 33. The larger end 32 (FIG. 6) fits over the toe of the user's boot and the smaller end 33 covers the heel of the boot. The shape of the sole 21 is generic to left and right feet and can be easily drawn over either one with equal facility.

The top and bottom surfaces of the inner panel 30 are lined as at 34 and 35 with a heat-sealable waterproof compound such as polyurethane, and the inner surface of the outer panel 31 is lined as at 36 with the same or a similar heat-sealable waterproof compound. The outer surface of the outer panel 31 is protectively coated as at 37 with a water impervious material such as SCOTCH GUARD.

The adjacent linings 35 and 36 of respective panels 30 and 31 are sealed together as at 100 pounds pressure and 400° F. for two seconds pre-seal, three seconds seal, and two seconds cooling. The sole is relatively rigid compared with the leg and foot portions 18 and 20.

The sole 21 is sealed to the foot portion 20 in a waterproof manner by heat sealing the lining 34 of the inner panel 30 to the outturned inner lining 23 at the bottom of the foot portion 20.

Figure 1:
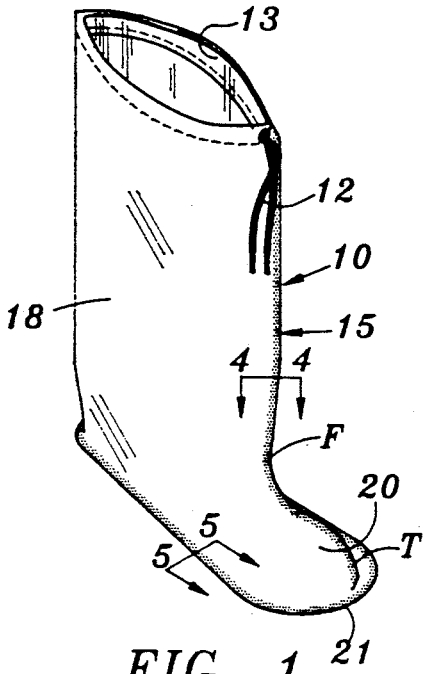
FIG. 1 is a perspective view of an overboot wader in an over-the-calf size.
Figure 4:
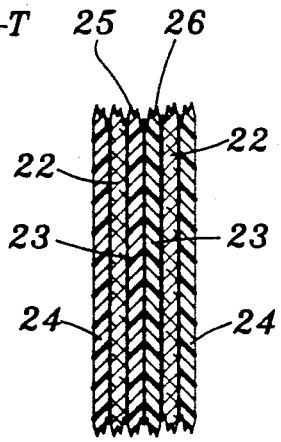
FIG. 4 is a sectional view taken substantially along the line 4—4 in FIG. 1.
Figure 2:
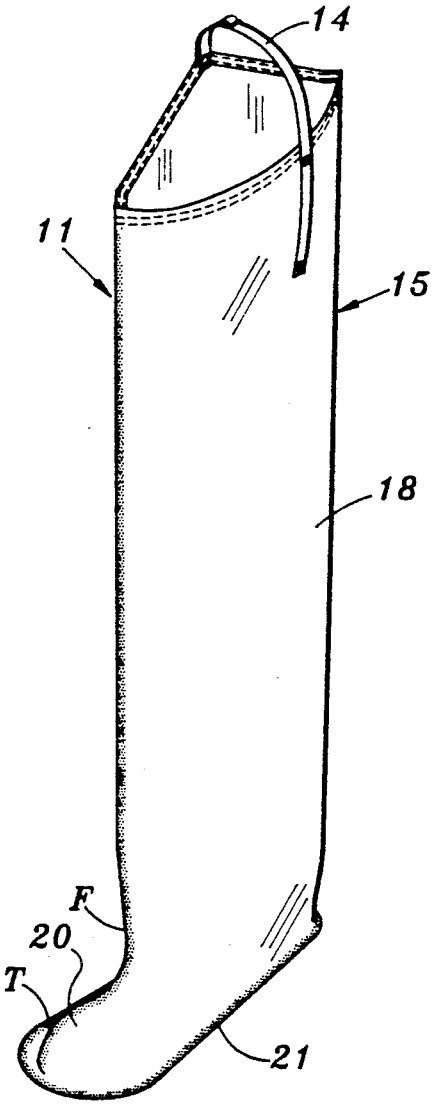
FIG. 2 is a perspective view of an overboot wader in a hip-length size.
Figure 3:
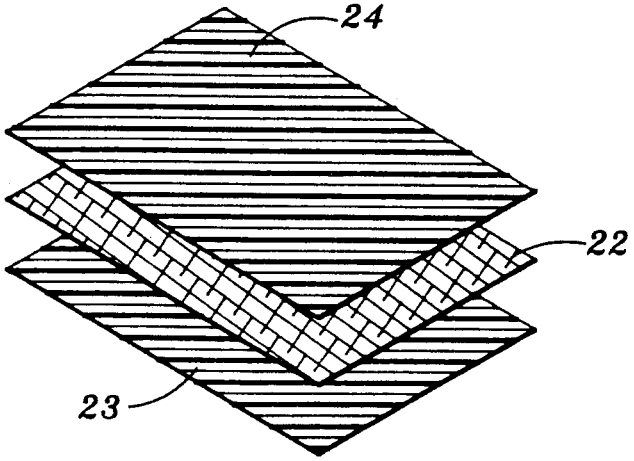
FIG. 3 is a somewhat schematic exploded view illustrating the three ply structure of the leg and foot portions of a first form of the invention.

A pair of completed waders of the type just described and shown in FIGS. 3 and 4 weighs less than fourteen ounces despite their rugged construction and generous proportions, and are sufficiently flexible to be easily rolled for storage, as in a backpack. They can be comfortably carried to the place they are needed for protection from water, as while standing in or wading across a stream or swampy ground.

Figure 7:
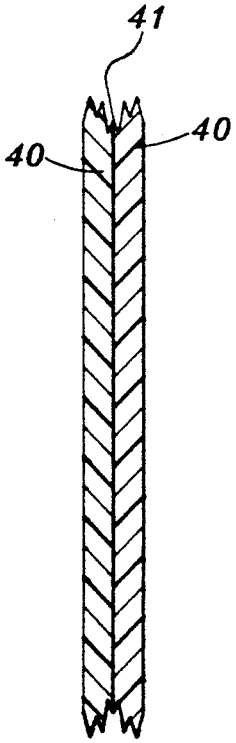
FIG. 7 is a sectional view similar to FIG. 4 but illustrating the two ply construction of the leg and foot portions of a modified form of the invention.

Referring to FIG. 7, a pair of waders made from polyvinylchloride weighs even less. FIG. 7 is a sectional view similar to FIG. 4, illustrating the single ply construction of the leg portion of waders made from polyvinylchloride. A single ply of polyvinylchloride 40 is formed into a tubular configuration and the abutting edges are fused together as by heat sealing, indicated at 41 in FIG. 7, to form the leg portion 19 and foot portion 20 of the wader.

Figure 5:
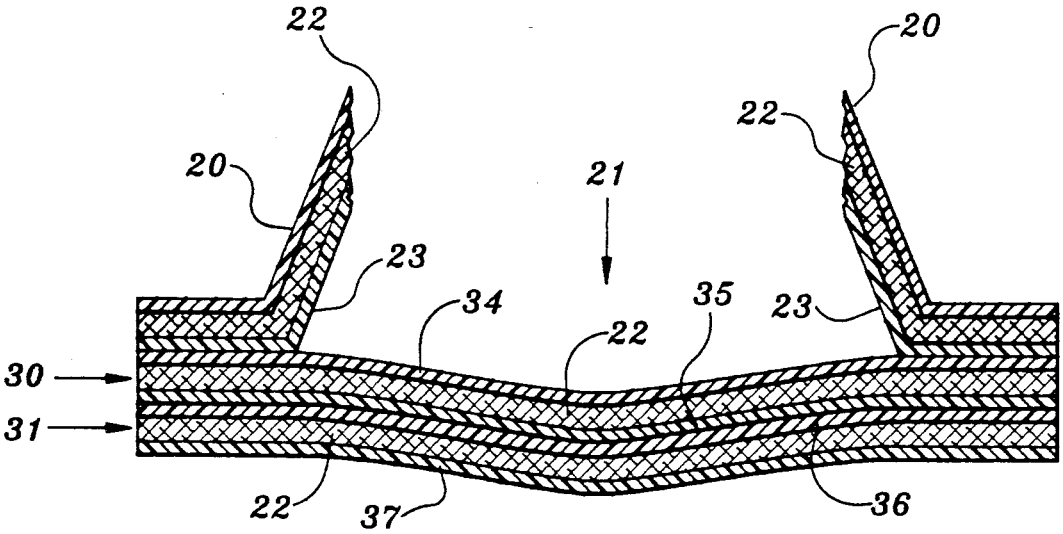
FIG. 5 is a sectional view, with parts broken away, taken substantially along the line 5—5 in FIG. 1 and illustrating the structure of the sole in the first form of the invention.

The sole 21 of a wader made from polyvinylchloride is formed of two plys of polyvinylchloride bonded as by heat sealing to each other and to the foot portion 20, as illustrated in FIG. 5 with reference to the first described form of the invention.

According to the invention, the user wears the usual comfortable hunting boots or other appropriate footwear and carries the overboot waders until they are needed for protection from wet ground or streams. The waders are drawn over the user's regular footwear only when needed for protection from water. They are removed from the feet and carried when not needed for protection from water. They have the advantage of being worn over the user's own comfortable footwear while protecting the user from wet feet, and of being easily removed when they are not needed. The waders are intended for limited but dependable use.

The utility of the waders also extends into the urban areas where they are useful accessories for such activities as car washing and snow removal.

Although specific terms have been used in describing the invention, they are used in a generic and descriptive sense only and not for the purpose of limitation.

I claim:

1. In an overboot wader having a leg portion, a foot portion and a sole, the improvement which comprises making the leg portion and foot portion from a first panel of a lightweight waterproof composition, said lightweight waterproof composition consisting of a single piece of tightly woven textile fabric, a heat-sealable waterproof liner adhered to the inner surface of said textile fabric and a coating of a water impervious substance on the outer surface of the textile fabric, and the sole consisting of two panels of the same lightweight waterproof composition heat sealed to each other and heat sealed to the first panel, whereby a pair of overboot waders may be conveniently folded into a compact package for carrying between intended uses of the overboot waders, as for wading across streams and standing in water while fishing.

2. An overboot wader according to claim 1 wherein the textile fabric is made with 500 denier nylon.

3. An overboot wader according to claim 1 wherein the marginal edges of the foot portion are out-turned in superposed relation to the marginal edges of the sole and the heat-sealable waterproof liner of the foot portion is heat-sealed to the proximal heat-sealable waterproof liner of the sole.

* * * * *